US011654545B2

(12) United States Patent
Toomey

(10) Patent No.: US 11,654,545 B2
(45) Date of Patent: May 23, 2023

(54) DUAL SPEED SQUARE

(71) Applicant: Peter Joseph Toomey, Liberty Hill, TX (US)

(72) Inventor: Peter Joseph Toomey, Liberty Hill, TX (US)

( * ) Notice: Subject to any disclaimer, the term of this patent is extended or adjusted under 35 U.S.C. 154(b) by 0 days.

(21) Appl. No.: 17/689,766

(22) Filed: Mar. 8, 2022

(65) Prior Publication Data

US 2022/0281098 A1 Sep. 8, 2022

Related U.S. Application Data

(60) Provisional application No. 63/158,249, filed on Mar. 8, 2021.

(51) Int. Cl.
*B43L 7/027* (2006.01)
*B25H 7/02* (2006.01)

(52) U.S. Cl.
CPC ..... *B25H 7/02* (2013.01); *B43L 7/0275* (2013.01)

(58) Field of Classification Search
CPC ..... B25H 7/02; B43L 7/0275
See application file for complete search history.

(56) References Cited

U.S. PATENT DOCUMENTS 4,361,964 A 12/1982 Hennessee
5,575,074 A 11/1996 Cottongim
5,813,216 A 9/1998 Hoshiba
8,074,368 B2 * 12/2011 Atwood ..... B25H 7/00 33/465
8,096,056 B1 * 1/2012 Murdock ..... G01B 3/566 33/526
8,146,260 B1 4/2012 Visser
2008/0301962 A1 12/2008 Haala
2010/0139106 A1 6/2010 Atwood
2022/0281098 A1 * 9/2022 Toomey ..... B43L 7/0275

FOREIGN PATENT DOCUMENTS

CN 203511071 U 4/2014

OTHER PUBLICATIONS

2-IN-1 Footer Rafter Square, Retrieved from Internet, Retrieved on Feb. 4, 2021 <URL: https://www.homedepot.com/p/Varney-Tools-2-in-1-Footer-Roof-Rafter-Square-Pack-of-2-032929/310533442>.
Speed Bevel Folding Square, Retrieved from Internet, Retrieved on Feb. 4, 2021 <URL: https://www.amazon.com/SWANSON-TOSB01-Speed-Folding-Square/dp/B004VQBRB0>.
Resin Pivot Square, Retrieved from Internet, Retrieved on Feb. 4, 2021 <URL: https://www.amazon.com/Hanson-03065-Pivot-Square-Nylon/dp/B0077CQCNI>.

* cited by examiner

*Primary Examiner* — Yaritza Guadalupe-McCall

(57) ABSTRACT

A dual speed square has a first triangle member, a second triangle member, and an intermediate connector. The first triangle member and the second triangle member are each laterally and hingedly connected to the intermediate connector opposite each other through a first hinge joint and a second hinge joint, respectively. The triangle members rotate respective to the intermediate connector between a deployed configuration and a stored configuration. In the deployed configuration, the triangle members may be placed on opposite sides of a workpiece in order to identically mark out the opposite sides of the workpiece. In the stored configuration, the triangle members are positioned adjacent to each other, occupying a smaller space than in the deployed configuration for easier transport and storage.

20 Claims, 6 Drawing Sheets

DUAL SPEED SQUARE

The current application claims a priority to the U.S. Provisional Patent application Ser. No. 63/158,249 filed on Mar. 8, 2021.

FIELD OF THE INVENTION

The present invention relates generally to carpentry tools. More particularly, the present invention relates to workpiece marking squares.

BACKGROUND OF THE INVENTION

A framing square is a multipurpose tool used in carpentry for "marking out", which is the process of transferring a design or pattern to a workpiece as the first step in a manufacturing process. The framing square has been in use for centuries and is referred to in text from the early 19th century. The framing square was commonly used to measure surfaces and mark patterns for all kinds of construction work. Most commonly it was used in roofing, stairway, framing and flooring projects. The original framing square was designed with a right angle to easily ensure a feature is perpendicular and a straight edge to ensure that the surface in question was completely flat and straight. Many framing squares are also designed with various types of rulers on the edges in order to mark specific measurements along the desired object. Uses for framing squares are endless, and individuals are constantly thinking up new applications for the framing square. Unfortunately, one issue with the framing square is that it is limited to marking one side of an object at a time. In many situations, measurements or markings are needed to be made simultaneously on two opposing sides of an object. In order to achieve this, individuals typically move the single framing square to the other side to make duplicate markings, or a secondary framing square may be used at the same time to attempt to match the first framing square in making the proper measurements. While good in theory, both methods have issues when it comes to accuracy and practicality. When moving the original square into position on the opposite side, the individual may unnecessarily waste time moving the framing square and repositioning it to the correct spot. Alternatively, if the individual uses multiple framing squares at once, the individual might not properly align the framing squares with each other, resulting in inaccurate measurement and marking, which could ruin the project in progress.

An objective of the present invention is to provide users with a double framing square to help the user mark both sides of a board simultaneously. The present invention intends to provide users with a device that can be stored with a physical footprint of approximately a single framing square and unfold to work as two parallel framing squares with a specified gap between them. In order to accomplish that, a preferred embodiment of the present invention comprises a first triangle, a second triangle, and a triangle connector. Further, the triangle connector comprises a plurality of hinge joints which allows the first triangle and the second triangle to be folded on top of each other in a configuration to switch back and forth between being a single framing square and two parallel framing squares. Thus, the present invention is a framing square that can be unfolded to make two conjoined parallel framing squares used for marking two sides of a board simultaneously.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

SUMMARY OF THE INVENTION

The present invention is a double framing square that allows for simultaneous measurements and markings on multiple sides of an object. The present invention seeks to provide users with a device that can be unfolded to become two parallel framing squares. In order to accomplish this the present invention comprises a first triangle member and a second triangle member that form two parallel framing squares when connected through a first and second hinge joint to an intermediate connector. At least one cutout, including a triangle cutout and a ruler cutout, allow the user to make measurements and marks along or within either side of the present invention. Additionally, the first and second triangle members may be rotated about the hinge joints from a deployed configuration into a stored configuration, creating a smaller overall size of the present invention for more convenient storage and transportation. Further, when the present invention is in the stored configuration, at least one fastener, such as a plurality of magnets, releasably affixes the present invention into the stored configuration. Thus, the present invention is a dual framing square that can be deployed to form two conjoined parallel framing squares used for accurately making identical markings on two opposite sides of a workpiece.

DETAIL DESCRIPTIONS OF THE INVENTION

Figure 1:
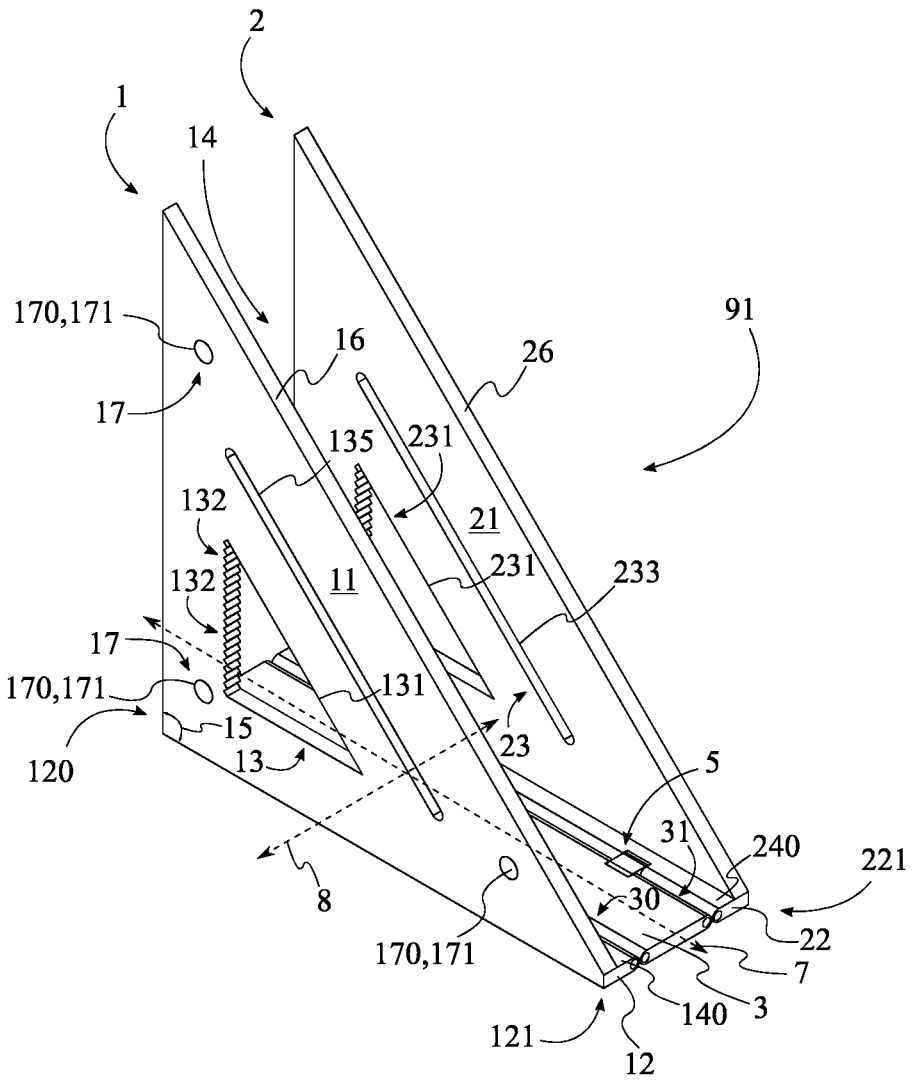
FIG. 1 is a front perspective view of the present invention in the deployed configuration.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure the focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising", when used herein, specify the presence of stated features, steps, operations, elements, various embodiments, and/or components, but do not preclude the presence or addition of one or more other features, steps, operations, elements, various embodiments, components, and/or groups thereof.

Unless otherwise defined, all terms (including technical and scientific terms) used herein have the same meaning as commonly understood by one having ordinary skill in the art to which this invention belongs. It will be further understood that terms, such as those used in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques, embodiments and/or steps are disclosed. Each of these has individual benefits and each can also be used in conjunction with one or more, or in some cases all, of the other disclosed techniques, embodiments and/or steps. Accordingly, for the sake of clarity, the present disclosure will refrain from repeating every possible combination of the individual steps, techniques or embodiments in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident however, to one skilled in the art, that the present invention may be practiced with or without these details or with other similar or otherwise suitable details.

The present disclosure is to be considered as an exemplification of the invention, and it is not intended to limit the invention to the specific embodiments illustrated by the figures or descriptions.

Figure 2:
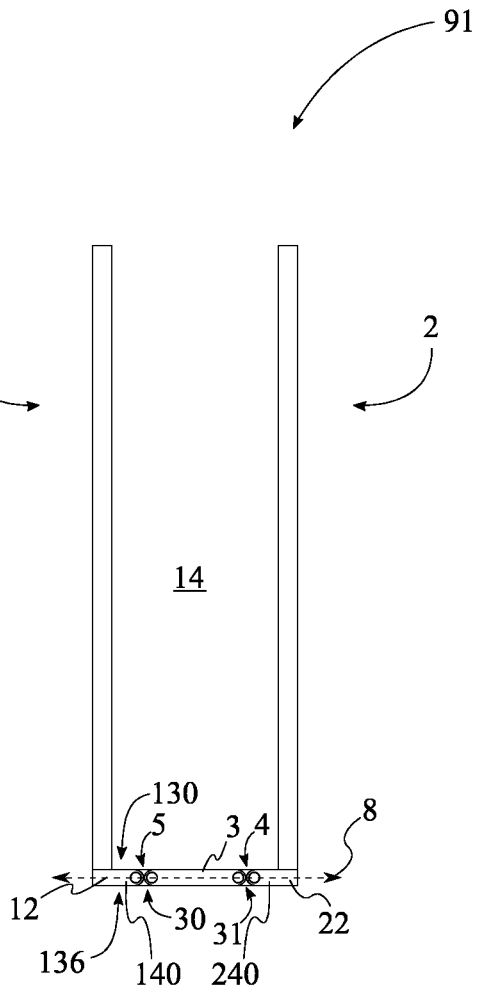
FIG. 2 is a front view of the present invention in the deployed configuration.

The present invention is a dual framing square. More particularly, the present invention is a dual speed square that may be used in carpentry or similar pursuits for marking and measuring a workpiece 6 in preparation for manufacturing the workpiece into a final product. It is an objective of the present invention to provide a device with two parallel framing squares connected together for the purpose of marking two opposing sides of a workpiece without having to move the marking device. In general, referring to FIGS. 1-2, the present invention comprises a first triangle member 1, a second triangle member 2, and an intermediate connector 3. The first triangle member 1 and the second triangle member 2 are connected to each other through the intermediate connector 3, which enables constrained positioning of the first triangle member 1 and the second triangle member 2 relative to each other. In various embodiments, the various components of the present invention may be constructed from any suitable material as desired. In some embodiments, the first triangle member 1, the second triangle member 2, and the intermediate connector 3 may all be constructed from a rigid, lightweight polymer material. In some embodiments, the first triangle member 1 and the second triangle member 2 may be constructed from a different material than the intermediate connector 3. In some embodiments, the first triangle member 1, the second triangle member 2, and/or and the intermediate connector 3 may be constructed from another suitable material, such as, but not limited to, steel, aluminum, wood, or various plastics. The present invention may be constructed through any suitable manufacturing method, such as, but not limited to, injection molding, additive manufacturing processes such as fused deposition modeling (FDM) or resin 3-D printing processes, CNC machining, milling, or other suitable processes.

Figure 3:
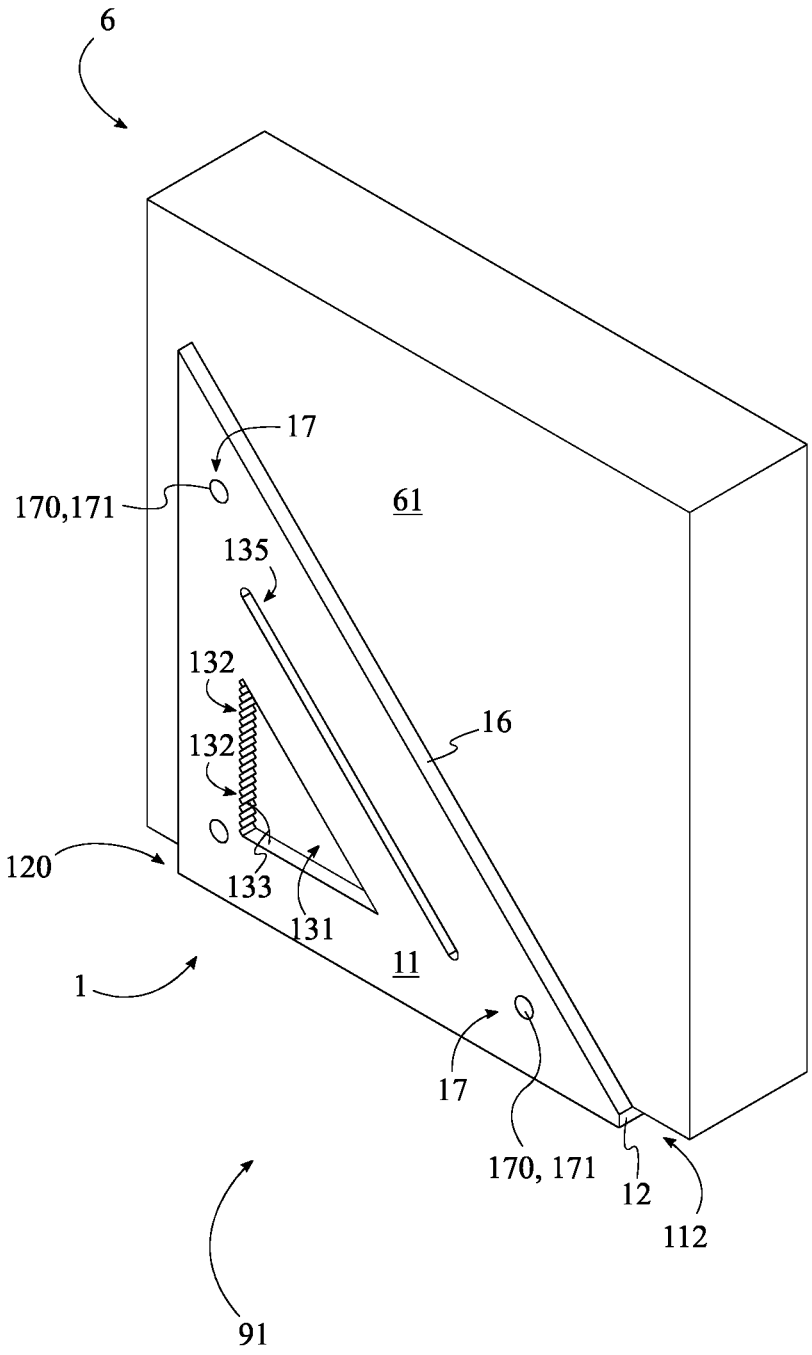
FIG. 3 is a front perspective view of the present invention in the deployed configuration in use with an exemplary workpiece.
Figure 4:
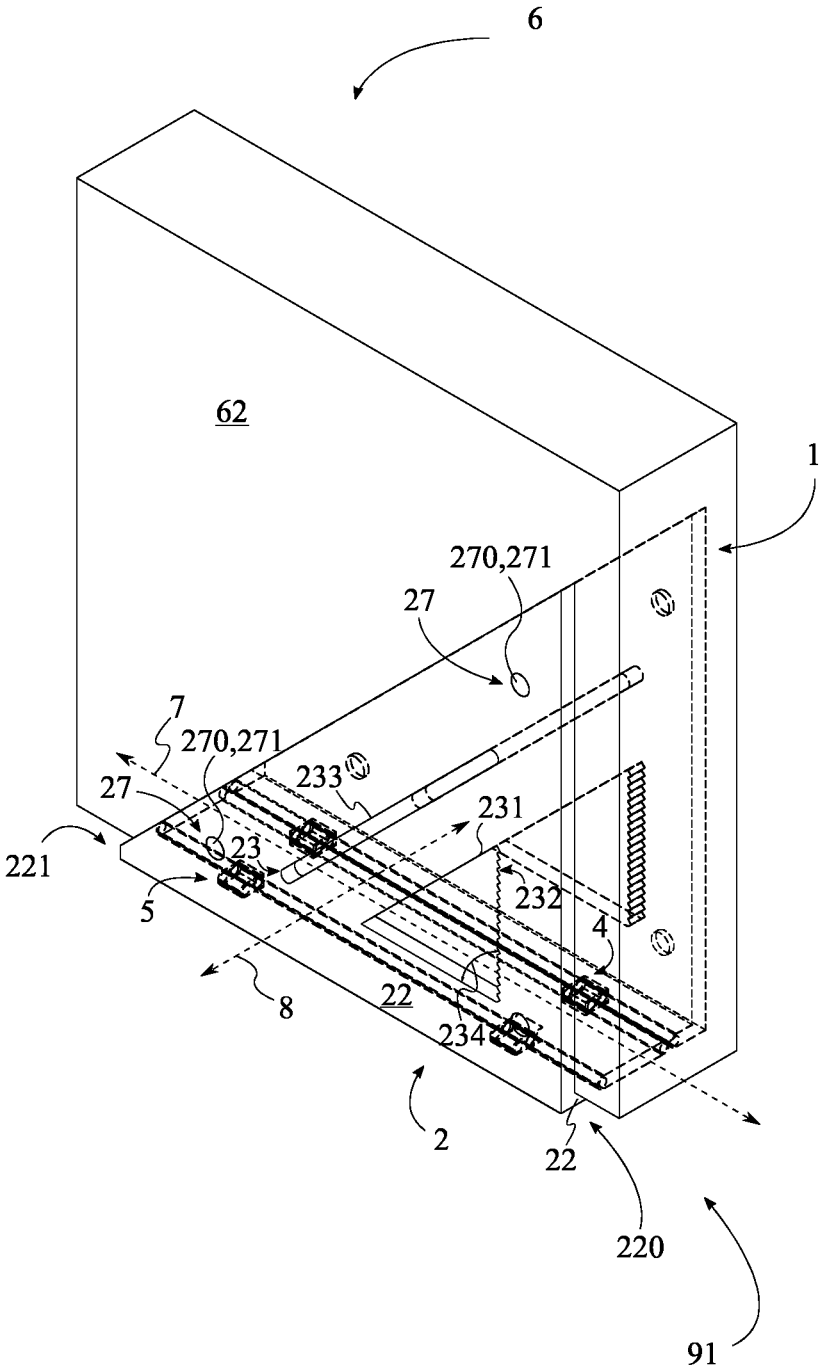
FIG. 4 is a rear perspective view of the present invention in the deployed configuration with hidden lines shown in use with an exemplary workpiece.

Using a typical singular speed square, in order to place the same markings on both sides of a workpiece 6, as illustrated in FIGS. 3-4, a user would position the speed square as desired on a first side 61 of the workpiece 6, make a first set of markings with a writing implement, scoring tool, or the link, move the speed square to a second side 62 of the workpiece 6, attempt to position the speed square on the second side 62 correspondingly opposite the positioning on the first side 61, and finally make a second set of markings on the second side 62. Using this method, user error may be introduced when moving the singular speed square from the first side 61 to the second side 62.

Using the present invention, however, the user may simply simultaneously position the first triangle member 1 adjacent to the first side 61 of the workpiece 6 and the second triangle member 2 adjacent to the second side 62 of the workpiece 6, make their first set of markings on the first side 61 using the first triangle member 1, then make their second set of identical markings on the second side 62 using the second triangle member 2, all while holding the present invention stationary against the workpiece 6, thus ensuring the two sets of markings are accurately duplicated and aligned with each other between the first side 61 and the second side 62 of the workpiece 6.

In the preferred embodiment of the present invention, the first triangle member 1 comprises a first triangle body 11, a first base 12, and at least one first cutout 131. Similarly, the second triangle member 2 comprises a second triangle body 21, a second base 22, and at least one second cutout 23.

The first base 12 comprises a first proximal end 120 and a first distal end 121. The first base 12 extends along a longitudinal direction 7 between the first proximal end 120 and the second distal end 221. Similarly, the second base 22 comprises a second proximal end 220 and a second distal end 221. The second base 22 extends along a longitudinal direction 7 between the second proximal end 220 and the second distal end 221.

The first triangle body 11 is connected perpendicular to the first base 12 between the first proximal end 120 and the first distal end 121, and the second triangle body 21 is connected perpendicular to the second base 22 between the second proximal end 220 and the second distal end 221. For each of the first triangle member 1 and the second triangle member 2, the respective triangle body is connected to a top side 130 of its respective base, opposite a bottom side 136 of the base. Each of the at least one first cutout 131 traverses through the first triangle body 11, and each of the at least one second cutout 23 traverses through the second triangle body 21. Generally, each cutout is provided for various measuring and marking purposes as known in the art. The cutouts allows the user to mark the workpiece 6 through the present invention without having to move the present invention, potentially ruining the accuracy of the mark or measurement. It should be further noted that, each cutout may be created in many various materials and the cutouts are not limited to the described shape and size and may be substituted for any alternative variation while still staying within the scope of the present invention.

Figure 5:
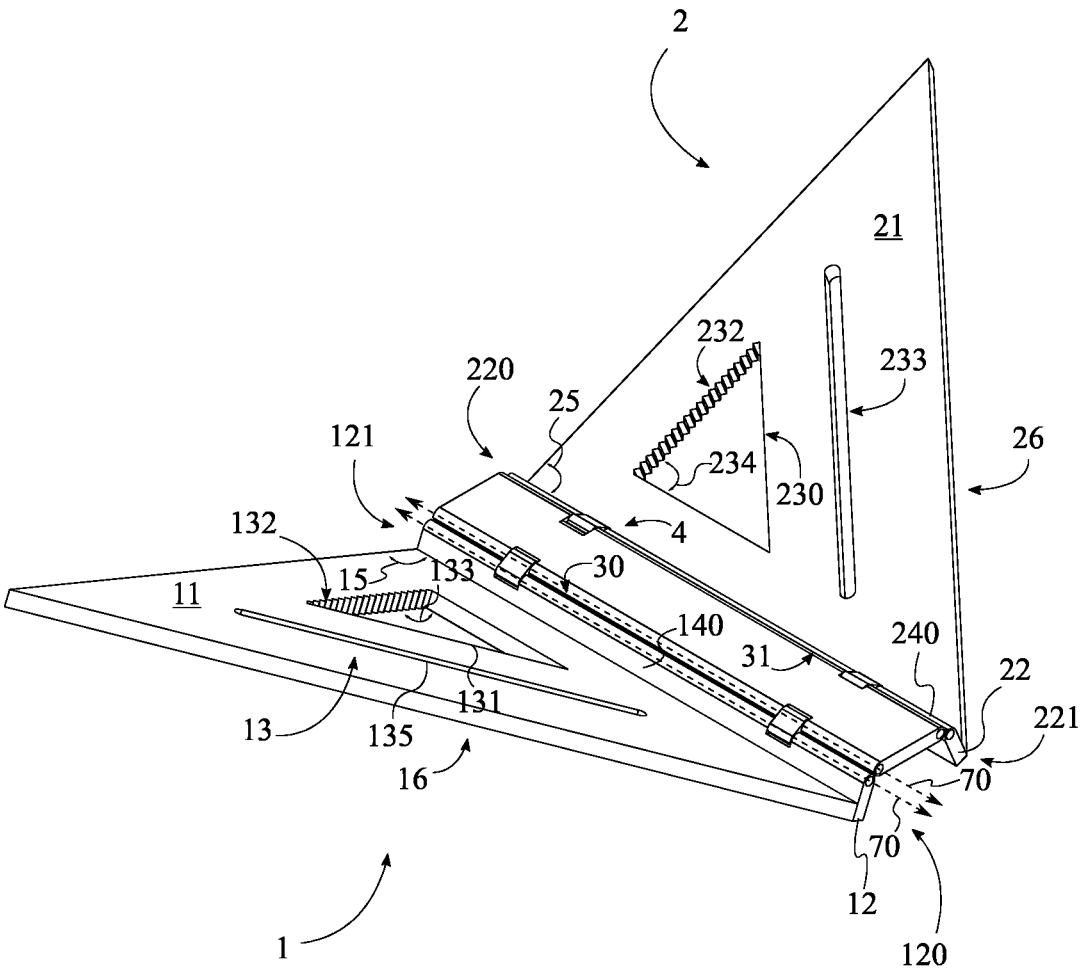
FIG. 5 is a front perspective view of the present invention with the first triangle member and the second triangle member positioned between the deployed configuration and the stored configuration.
Figure 6:
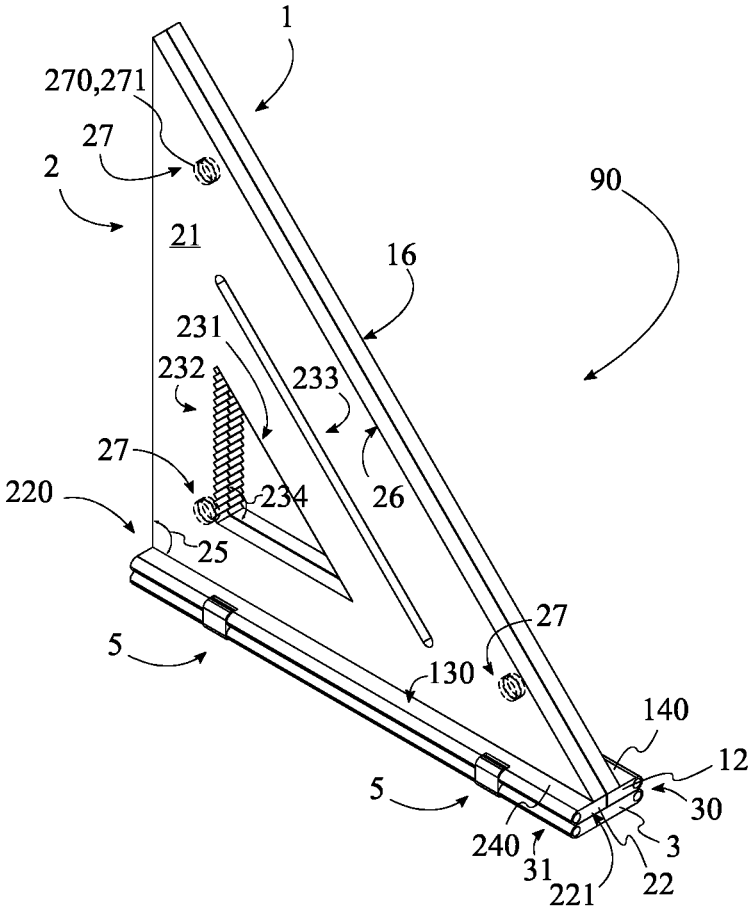
FIG. 6 is a front perspective view of the present invention in the stored configuration.

In the preferred embodiment, the intermediate connector 3 is laterally and hingedly connected to the first base 12, while the second base 22 is laterally and hingedly connected to the intermediate connector 3 opposite the first base 12. The lateral direction 8 referenced is perpendicular to the longitudinal direction 7 defined by the proximal and distal ends of the bases, wherein the bases extend lengthwise along the longitudinal direction 7 and widthwise along the lateral direction 8. Through this arrangement, the second triangle member 2 is hingedly connected to, and manually positionable by a user relative to the first triangle member 1 through the intermediate connector 3 between a stored configuration 90 and a deployed configuration 91. FIGS. 1-4 show the present invention in the deployed configuration 91. FIG. 5 shows the present invention with the first triangle member 1 and the second triangle member 2 positioned partially between the deployed configuration 91 and the stored configuration 90. In the stored configuration 90, as shown in FIG. 6, the first triangle member 1 and the second triangle member 2 are positioned adjacent to and preferably layered adjacent to each other, such that the present invention occupies a footprint in physical space approximately equal to only a single triangle member for convenience in storage and transportation. Furthermore, in the deployed configuration 91, the first triangle member 1 and the second triangle member 2 are oriented parallel to each other and laterally separated from each other by the intermediate connector 3. The lateral separation between the first triangle member 1 and the second triangle member 2 provides a receiving space 14 to receive a workpiece 6 therein in order to make duplicate markings on both sides of the workpiece 6.

Further, in the preferred embodiment, the intermediate connector 3 comprises a first lateral side 30 and a second lateral side 31. Preferably, the intermediate connector 3 has a rectangular prismatic shape, though the intermediate connector 3 may have any suitable shape in various embodiments as desired. The first lateral side 30 of the intermediate connector 3 is hingedly connected to the first base 12, and the second lateral side 31 is hingedly connected to the second base 22.

Further, in the preferred embodiment, the present invention comprises a first hinge joint 4 and a second hinge joint 5. The first hinge joint 4 and the second hinge joint 5, in conjunction with the intermediate connector 3, enable the configurable nature of the present invention between the stored configuration 90 and the deployed configuration 91.

The first base 12 is laterally and hingedly connected to the first lateral side 30 of the intermediate connector 3 through the first hinge joint 4, while the second base 22 is laterally and hingedly connected to the second lateral side 31 of the intermediate connector 3 through the second hinge joint 5, opposite the first triangle member 1. The first hinge joint 4 and the second hinge joint 5 enable rotation of the intermediate connector 3 relative to the first triangle member 1 and the second triangle member 2, respectively. In the preferred embodiment of the present invention, while enabling said rotation, the first hinge joint 4 and the second hinge joint 5 each further constrain the rotation to axes 70 parallel to the longitudinal direction 7.

In various embodiments, the first hinge joint 4 and the second hinge joint 5 may be embodied in any suitable configuration as any suitable component or combination of components that enables the desired hinging functionality of the present invention. In some embodiments, the first hinge joint 4 and the second hinge joint 5 may be a pin joint, a hinge with leaves and mating knuckle components, or any other suitable mechanical hinge configuration. In some embodiments, the first hinge joint 4 and the second hinge joint 5 may be embodied as portions of flexible material integrated into or connected between the intermediate connector 3 and the bases of the first triangle member 1 and the second triangle member 2. In some embodiments, for example, the first hinge joint 4 and the second hinge joint 5 may be constructed through a single layer of an adhesive tape, fabric, or other suitable material being adhered to and across the bottom sides of the first triangle member 1, the intermediate connector 3, and the second triangle member 2.

In some embodiments, the first hinge joint 4 and the second hinge joint 5 may be portions of compliant polymer material or other suitable material manufactured integral to the intermediate connector 3 or all of the first triangle member 1, intermediate connector 3, and second triangle member 2. In some embodiments, the first hinge joint 4 and the second hinge joint 5 may be detachable from the intermediate connector 3, the triangle members, or both.

In the preferred embodiment, the first base 12 comprises at least one first lip 140, and the second base 22 comprises at least one second lip 240. Preferably, each of the at least one first lip 140 extends laterally from the first base 12, while the at least one second lip 240 extends laterally from the second base 22, though this is not necessarily a strict requirement. One of the at least one first lip 140 is connected to the intermediate connector 3, while one of the at least one second lip 240 is connected to the intermediate connector 3 opposite the at least one first lip 140. In the preferred embodiment, in the stored configuration 90, the first base 12 and the second base 22 are positioned adjacent to each other in the stored configuration 90, such that the at least one first lip 140 and the at least one second lip 240 are oriented laterally opposite each other in the stored configuration 90.

In the preferred embodiment of the present invention, the first triangle member 1 further comprises a first right angle 15, and the second triangle member 2 further comprises a second right angle 25, wherein the first triangle member 1 and the second triangle member 2 are each an isosceles right triangle, as is typical for speed squares. However, it is contemplated that in various embodiments, the first triangle member 1 and the second triangle member 2 may have different geometrical shapes to correspond to other types of framing squares or new geometries for framing squares as desired. In the preferred embodiment, the first right angle 15 is positioned adjacent to the first proximal end 120 of the first base 12, and the second right angle 25 is positioned adjacent to the second proximal end 220 of the second base 22.

Further, in the preferred embodiment, the at least one first cutout 131 comprises a first triangle cutout and the at least one second cutout 23 comprises a second triangle cutout 23. The first triangle cutout comprises a first plurality of notches 132 and the second triangle cutout 23 comprises a second plurality of notches 232, as is commonly found as a feature in current framing squares. Further, the first triangle cutout comprises a first cutout right angle 133 while the second triangle cutout 23 comprises a second cutout right angle 233 in the preferred embodiment. In some embodiments, the first cutout right angle 133 is offset from the first right angle 15, while the second cutout right angle 233 is offset from the second right angle 25. More particularly, in some embodiments, the first cutout right angle 133 is offset from the first right angle 15 of the first triangle body 11 and positioned equidistantly between the first proximal end 120 and the first base 12, while the second cutout right angle 233 is offset from the second right angle 25 of the second triangle body 21 and positioned equidistantly between the second proximal end 220 and the second base 22. Further, the first plurality of notches 132 is distributed along the first triangle cutout, positioned longitudinally offset from the first proximal end 120 and terminating adjacent to the first cutout right angle 133. Similarly, the second plurality of notches 232 is distributed along the second triangle cutout 23, positioned longitudinally offset from the second proximal end 220 and terminating adjacent to the second cutout right angle 233.

Further, in the preferred embodiment, the at least first one cutout comprises a first ruler cutout 135, wherein the first triangle body 11, being an isosceles triangle, has a first hypotenuse edge 16 opposite the first right angle 15. The first ruler cutout 135 is oriented parallel to the first hypotenuse edge 16. Similarly, the at least one second cutout 23 comprises a second ruler cutout 234, wherein the second triangle body 21 has a second hypotenuse edge 26 opposite the second right angle 25. The second ruler cutout 234 is oriented parallel to the second hypotenuse edge 26.

Further, in some embodiments, the first triangle member 1 comprises at least one first fastener 17, while the second triangle member 2 comprises at least one second fastener 27. Each of the at least one first fastener 17 is connected to the first triangle body 11, and each of the at least one second fastener 27 is connected to the second triangle body 21. The at least one fastener the at least one fastener are removably attached to each other in the stored configuration 90. That is, after positioning the first triangle member 1 and the second triangle member 2 into the stored configuration 90, the at least one first fastener 17 and the at least one second fastener 27 may be removably attached to each other in order to secure the present invention into the stored configuration 90.

In some embodiments, the first triangle member 1 further comprises at least one first magnet 170 as the at least one first fastener 17, while the second triangle member 2 further comprises at least one second magnet 270 as the at least one second fastener 27. The at least one first magnet 170 is connected to the first triangle body 11, and the at least one second magnet 270 is connected to the second triangle body 21. The at least one first magnet 170 and the at least one second magnet 270 are positioned respectively with each other on the first triangle body 11 and second triangle body 21, respectively so that the at least one first magnet 170 and at least one second magnet 270 are releasably and magnetically engaged with each other in the stored configuration 90. In some embodiments, a single magnet may be positioned adjacent to the proximal ends and offset from the bases for each of the first triangle member 1 and the second triangle member 2.

In some embodiments, the at least one first magnet 170 comprises a first plurality of magnets 171 and the at least one second magnet 270 comprises a second plurality of magnets 271. The first plurality of magnets 171 is distributed about the first triangle body 11 and the second plurality of magnets 271 is distributed about the second triangle body 21 in order to achieve a robust magnetic connection between the triangle bodies of the first triangle member 1 and the second triangle member 2. The specific positioning of the first plurality of magnets 171 and second plurality of magnets 271 may vary in different embodiments. In an exemplary embodiment, each of the first plurality of magnets 171 and the second plurality of magnets 271 may comprise three magnets, each positioned approximately nearby one of the vertices of the respective triangle bodies.

Preferably, the aforementioned magnetic engagement is achieved automatically upon positioning the present invention into the stored configuration 90, as doing so positions the magnets of the first triangle member 1 and the second triangle member 2 within effective magnetic range of each other, and thus magnetically attract each other. It is contemplated that in various embodiments, various other types, configurations, and/or arrangements of fasteners, clips, clasps, or other suitable mating features may be included to achieve the same purpose.

Although the invention has been explained in relation to its preferred embodiment, it is to be understood that many other possible modifications and variations can be made without departing from the spirit and scope of the invention as hereinafter claimed.

What is claimed is:

1. A dual speed square comprising:

a first triangle member;

a second triangle member;

an intermediate connector;

the first triangle member comprising a first triangle body, a first base, and at least one first cutout;

the second triangle member comprising a second triangle body, a second base, and at least one second cutout;

the first base comprising a first proximal end and a first distal end;

the second base comprising a second proximal end and a second distal end;

the first base extending along a longitudinal direction between the first proximal end and the first distal end;

the second base extending along a longitudinal direction between the second proximal end and the second distal end;

the first triangle body being connected perpendicular to the first base between the first proximal end and the first distal end;

the second triangle body being connected perpendicular to the second base between the second proximal end and the second distal end;

each of the at least one first cutout traversing through the first triangle body;

each of the at least one second cutout traversing through the second triangle body;

the intermediate connector being laterally and hingedly connected to the first base; and the second base being laterally and hingedly connected to the intermediate connector opposite the first base, wherein the second triangle member is hingedly connected to the first triangle member through the intermediate connector between a stored configuration and a deployed configuration, wherein the first triangle member and the second triangle member are positioned adjacent to each other in the stored configuration, and wherein the first triangle member and the second triangle member are oriented parallel to each other and laterally separated from each other by the intermediate connector in the deployed configuration.

2. The dual speed square as claimed in claim 1 comprising:

the intermediate connector comprising a first lateral side and a second lateral side;

the first lateral side being hingedly connected to the first base; and the second lateral side being hingedly connected to the second base.

3. The dual speed square as claimed in claim 1 comprising:

a first hinge joint;

a second hinge joint;

the first base being laterally and hingedly connected to a first lateral side of the intermediate connector through the first hinge joint; and the second base being laterally and hingedly connected to a second lateral side of the intermediate connector opposite the first triangle member through the second hinge joint.

4. The dual speed square as claimed in claim 1 comprising:

the first base comprising at least one first lip;

the second base comprising at least one second lip;

each of the at least one first lip extending laterally from the first base;

each of the at least one second lip extending laterally from the second base;

the at least one first lip being hingedly connected to the intermediate connector; and the at least one second lip being hingedly connected to the intermediate connector opposite the at least one first lip.

5. The dual speed square as claimed in claim 4 comprising:

the first base and the second base being positioned adjacent to each other in the stored configuration; and the at least one first lip and the at least one second lip being oriented laterally opposite each other in the stored configuration.

6. The dual speed square as claimed in claim 1 comprising:

the first triangle member further comprising a first right angle;

the second triangle member further comprising a second right angle;

the first right angle being positioned adjacent to the first proximal end of the first base;

the second right angle being positioned adjacent to the second proximal end of the second base;

the at least one first cutout comprising a first triangle cutout;

the at least one second cutout comprising a second triangle cutout;

the first triangle cutout comprising a first plurality of notches and a first cutout right angle, wherein the first triangle cutout is a right triangle;

the second triangle cutout comprising a second plurality of notches and a second cutout right angle, wherein the second triangle cutout is a right triangle;

the first cutout right angle being offset from the first right angle of the first triangle body;

the second cutout right angle being offset from the second right angle of the second triangle body;

the first plurality of notches being distributed along the first triangle cutout, positioned longitudinally offset from the first proximal end; and the second plurality of notches being distributed along the second triangle cutout, positioned longitudinally offset from the second proximal end.

7. The dual speed square as claimed in claim 1 comprising:

the at least one first cutout comprising a first ruler cutout;

the at least one second cutout comprising a second ruler cutout;

the first triangle body comprising a first hypotenuse edge;

the second triangle body comprising a second hypotenuse edge;

the first ruler cutout being oriented parallel to the first hypotenuse edge; and the second ruler cutout being oriented parallel to the second hypotenuse edge.

8. The dual speed square as claimed in claim 1 comprising:

the first triangle member further comprising at least one first fastener;

the second triangle member further comprising at least one second fastener;

each of the at least one first fastener being connected to the first triangle body;

each of the at least one second fastener being connected to the second triangle body; and the at least one first fastener and the at least one second fastener being removably attached to each other in the stored configuration.

9. The dual speed square as claimed in claim 1 comprising:

the first triangle member further comprising at least one first magnet;

the second triangle member further comprising at least one second magnet;

each of the at least one first magnet being connected to the first triangle body;

each of the at least one second magnet being connected to the second triangle body; and the at least one first magnet and the at least one second magnet being releasably engaged with each other in the stored configuration.

10. The dual speed square as claimed in claim 9 comprising:

the at least one first magnet comprising a first plurality of magnets;

the at least one second magnet comprising a second plurality of magnets;

the first plurality of magnets being distributed about the first triangle body; and the second plurality of magnets being distributed about the second triangle body.

11. A dual speed square comprising:

a first triangle member;

a second triangle member;

an intermediate connector;

the first triangle member comprising a first triangle body, a first base, and at least one first cutout;

the second triangle member comprising a second triangle body, a second base, and at least one second cutout;

the first base comprising a first proximal end and a first distal end;

the second base comprising a second proximal end and a second distal end;

the first base extending along a longitudinal direction between the first proximal end and the first distal end;

the second base extending along a longitudinal direction between the second proximal end and the second distal end;

the first triangle body being connected perpendicular to the first base between the first proximal end and the first distal end;

the second triangle body being connected perpendicular to the second base between the second proximal end and the second distal end;

each of the at least one first cutout traversing through the first triangle body;

each of the at least one second cutout traversing through the second triangle body;

the intermediate connector being laterally and hingedly connected to the first base;

the second base being laterally and hingedly connected to the intermediate connector opposite the first base, wherein the second triangle member is hingedly connected to the first triangle member through the intermediate connector between a stored configuration and a deployed configuration, wherein the first triangle member and the second triangle member are positioned adjacent to each other in the stored configuration, and wherein the first triangle member and the second triangle member are oriented parallel to each other and laterally separated from each other by the intermediate connector in the deployed configuration;

the intermediate connector comprising a first lateral side and a second lateral side;

the first lateral side being hingedly connected to the first base; and the second lateral side being hingedly connected to the second base;

a first hinge joint;

a second hinge joint;

the first base being laterally and hingedly connected to a first lateral side of the intermediate connector through the first hinge joint; and the second base being laterally and hingedly connected to a second lateral side of the intermediate connector opposite the first triangle member through the second hinge joint.

12. The dual speed square as claimed in claim 11 comprising:

the first base comprising at least one first lip;

the second base comprising at least one second lip;

each of the at least one first lip extending laterally from the first base;

each of the at least one second lip extending laterally from the second base;

the at least one first lip being hingedly connected to the intermediate connector;

the at least one second lip being hingedly connected to the intermediate connector opposite the at least one first lip;

the first base and the second base being positioned adjacent to each other in the stored configuration; and the at least one first lip and the at least one second lip being oriented laterally opposite each other in the stored configuration.

13. The dual speed square as claimed in claim 11 comprising:

the first triangle member further comprising a first right angle;

the second triangle member further comprising a second right angle;

the first right angle being positioned adjacent to the first proximal end of the first base;

the second right angle being positioned adjacent to the second proximal end of the second base;

the at least one first cutout comprising a first triangle cutout;

the at least one second cutout comprising a second triangle cutout;

the first triangle cutout comprising a first plurality of notches and a first cutout right angle, wherein the first triangle cutout is a right triangle;

the second triangle cutout comprising a second plurality of notches and a second cutout right angle, wherein the second triangle cutout is a right triangle;

the first cutout right angle being offset from the first right angle of the first triangle body;

the second cutout right angle being offset from the second right angle of the second triangle body;

the first plurality of notches being distributed along the first triangle cutout, positioned longitudinally offset from the first proximal end;

the second plurality of notches being distributed along the second triangle cutout, positioned longitudinally offset from the second proximal end;

the at least one first cutout comprising a first ruler cutout;

the at least one second cutout comprising a second ruler cutout;

the first triangle body comprising a first hypotenuse edge;

the second triangle body comprising a second hypotenuse edge;

the first ruler cutout being oriented parallel to the first hypotenuse edge; and the second ruler cutout being oriented parallel to the second hypotenuse edge.

14. The dual speed square as claimed in claim 11 comprising:

the first triangle member further comprising at least one first fastener;

the second triangle member further comprising at least one second fastener;

each of the at least one first fastener being connected to the first triangle body;

each of the at least one second fastener being connected to the second triangle body; and the at least one first fastener and the at least one second fastener being removably attached to each other in the stored configuration.

15. The dual speed square as claimed in claim 11 comprising:

the first triangle member further comprising at least one first magnet;

the second triangle member further comprising at least one second magnet;

each of the at least one first magnet being connected to the first triangle body;

each of the at least one second magnet being connected to the second triangle body;

the at least one first magnet and the at least one second magnet being releasably engaged with each other in the stored configuration;

the at least one first magnet comprising a first plurality of magnets;

the at least one second magnet comprising a second plurality of magnets;

the first plurality of magnets being distributed about the first triangle body; and the second plurality of magnets being distributed about the second triangle body.

16. A dual speed square comprising:

a first triangle member;

a second triangle member;

an intermediate connector;

the first triangle member comprising a first triangle body, a first base, and at least one first cutout;

the second triangle member comprising a second triangle body, a second base, and at least one second cutout;

the first base comprising a first proximal end and a first distal end;

the second base comprising a second proximal end and a second distal end;

the first base extending along a longitudinal direction between the first proximal end and the first distal end;

the second base extending along a longitudinal direction between the second proximal end and the second distal end;

the first triangle body being connected perpendicular to the first base between the first proximal end and the first distal end;

the second triangle body being connected perpendicular to the second base between the second proximal end and the second distal end;

each of the at least one first cutout traversing through the first triangle body;

each of the at least one second cutout traversing through the second triangle body;

the intermediate connector being laterally and hingedly connected to the first base;

the second base being laterally and hingedly connected to the intermediate connector opposite the first base, wherein the second triangle member is hingedly connected to the first triangle member through the intermediate connector between a stored configuration and a deployed configuration, wherein the first triangle member and the second triangle member are positioned adjacent to each other in the stored configuration, and wherein the first triangle member and the second triangle member are oriented parallel to each other and laterally separated from each other by the intermediate connector in the deployed configuration;

a first hinge joint;

a second hinge joint;

the first base being laterally and hingedly connected to a first lateral side of the intermediate connector through the first hinge joint;

the second base being laterally and hingedly connected to a second lateral side of the intermediate connector opposite the first triangle member through the second hinge joint;

the first triangle member further comprising at least one first fastener;

the second triangle member further comprising at least one second fastener;

each of the at least one first fastener being connected to the first triangle body;

each of the at least one second fastener being connected to the second triangle body; and the at least one first fastener and the at least one second fastener being removably attached to each other in the stored configuration.

17. The dual speed square as claimed in claim 16 comprising:

the intermediate connector comprising a first lateral side and a second lateral side;

the first lateral side being hingedly connected to the first base; and the second lateral side being hingedly connected to the second base.

18. The dual speed square as claimed in claim 16 comprising:

the first base comprising at least one first lip;

the second base comprising at least one second lip;

each of the at least one first lip extending laterally from the first base;

each of the at least one second lip extending laterally from the second base;

the at least one first lip being hingedly connected to the intermediate connector;

the at least one second lip being hingedly connected to the intermediate connector opposite the at least one first lip;

the first base and the second base being positioned adjacent to each other in the stored configuration; and the at least one first lip and the at least one second lip being oriented laterally opposite each other in the stored configuration.

19. The dual speed square as claimed in claim 16 comprising:

the first triangle member further comprising a first right angle;

the second triangle member further comprising a second right angle;

the first right angle being positioned adjacent to the first proximal end of the first base;

the second right angle being positioned adjacent to the second proximal end of the second base;

the at least one first cutout comprising a first triangle cutout;

the at least one second cutout comprising a second triangle cutout;

the first triangle cutout comprising a first plurality of notches and a first cutout right angle, wherein the first triangle cutout is a right triangle;

the second triangle cutout comprising a second plurality of notches and a second cutout right angle, wherein the second triangle cutout is a right triangle;

the first cutout right angle being offset from the first right angle of the first triangle body;

the second cutout right angle being offset from the second right angle of the second triangle body;

the first plurality of notches being distributed along the first triangle cutout, positioned longitudinally offset from the first proximal end;

the second plurality of notches being distributed along the second triangle cutout, positioned longitudinally offset from the second proximal end;

the at least one first cutout comprising a first ruler cutout;

the at least one second cutout comprising a second ruler cutout;

the first triangle body comprising a first hypotenuse edge;

the second triangle body comprising a second hypotenuse edge;

the first ruler cutout being oriented parallel to the first hypotenuse edge; and the second ruler cutout being oriented parallel to the second hypotenuse edge.

20. The dual speed square as claimed in claim 16 comprising:

the first triangle member further comprising at least one first magnet;

the second triangle member further comprising at least one second magnet;

each of the at least one first magnet being connected to the first triangle body;

each of the at least one second magnet being connected to the second triangle body;

the at least one first magnet and the at least one second magnet being releasably engaged with each other in the stored configuration;

the at least one first magnet comprising a first plurality of magnets;

the at least one second magnet comprising a second plurality of magnets;

the first plurality of magnets being distributed about the first triangle body; and the second plurality of magnets being distributed about the second triangle body.

* * * * *